US006331237B1

(12) United States Patent
Andricacos et al.

(10) Patent No.: US 6,331,237 B1
(45) Date of Patent: Dec. 18, 2001

(54) METHOD OF IMPROVING CONTACT RELIABILITY FOR ELECTROPLATING

(75) Inventors: Panayotis C. Andricacos, Croton-on-Hudson; W. Jean Horkans, Ossining; Keith T. Kwietniak, Highland Falls; Peter S. Locke, Hopewell Junction, all of NY (US); Cyprian E. Uzoh, Milpitas, CA (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/387,856

(22) Filed: Sep. 1, 1999

(51) Int. Cl.[7] ..... C25D 21/06; C25D 21/16; C25D 5/02

(52) U.S. Cl. ..... 205/98; 205/123

(58) Field of Search ..... 205/123, 98

(56) References Cited

U.S. PATENT DOCUMENTS

| | | | | |
|---|---|---|---|---|
| 5,198,273 | * | 3/1993 | Ando et al. | 427/437 |
| 5,425,859 | * | 6/1995 | Tench et al. | 204/153.1 |
| 5,612,254 | | 3/1997 | Mu et al. | 437/195 |
| 5,814,557 | * | 9/1998 | Venkatraman et al. | 438/622 |
| 5,968,333 | * | 10/1999 | Nogami et al. | 205/184 |
| 5,972,192 | * | 10/1999 | Dubin et al. | 205/101 |
| 6,146,517 | * | 11/2000 | Hoinkis | 205/186 |

OTHER PUBLICATIONS

D. C. Edelstein, "Advantages of Copper Interconnects," 1995 VMIC Conference, Jun. 27–29, 1995, 1995 ISMIC vol. 104, pp. 301–307.

Luther, B., et al., "Planar Copper–Polyimide Back End Use of the Line Interconnections for ULSI Devices," 1993 VMIC Conference, Jun. 8–9, 1995, 1993 ISMIC vol. 102, pp. 15–21.

Andricacos, P.C., et al., "Damascene Copper Electroplating for Chip Interconnections," *J. Res. Develop.*, vol. 42, No. 5, Sep. 1998, pp. 567–574.

* cited by examiner

*Primary Examiner*—Kathryn Gorgos
*Assistant Examiner*—Erica Smith-Hicks
(74) *Attorney, Agent, or Firm*—Connolly Bove Lodge & Hutz, LLP; Robert M. Trepp, Esq

(57) ABSTRACT

A method of reducing etching of a seed layer by a plating solution. Prior to introducing the semiconductor wafer with the seed layer into the plating solution, the etching power of the plating solution is diminished.

17 Claims, 2 Drawing Sheets

METHOD OF IMPROVING CONTACT RELIABILITY FOR ELECTROPLATING

FIELD OF THE INVENTION

The invention relates to plating metals in semiconductor chip applications. In particular, the present invention relates to protecting very thin current carrying layers from attack by a plating solution.

BACKGROUND OF THE INVENTION

Metals are utilized for a variety of applications in semiconductor chips. One example of such applications includes the interconnect wiring. One means of depositing interconnect structures of some metals is electroplating on to semiconductor structures.

Recently, copper has started to replace aluminum in interconnect structures in integrated circuit chips. Replacement of aluminum with copper stems at least in part from the lower electrical resistivity of copper. As a result, utilizing copper has resulted in an improvement in IC chip performance. These advantages are described by Luther et al., Proceedings of the 10th International IEEE VLSI Multilevel Interconnection Conference, 1993, p. 15; and by Edelstein, Proceedings of the 12th International IEEE VLSI Multilevel Interconnection Conference, 1995, p. 301, the entire contents of both of which are hereby incorporated by reference.

One method that may be utilized to deposit copper for on-chip interconnect structures is the damascene method. U.S. Pat. No. 5,612,254, the entire contents of the disclosure of which are incorporated herein by reference, discloses a damascene process. Typically, copper is electroplated to form the structures, as described by Andricacos et al., IBM J. Res. Develop., 42, 567 (1998), the entire contents of the disclosure of which is hereby incorporated by reference. Electroplating and the damascene method provide a lower cost versatile method for deposition of copper.

Electroplated damascene technology typically starts with the deposition on a semiconductor wafer and patterning of dielectric material. Next, a barrier material may be deposited over an entire surface of the wafer including the dielectric material and any underlying portions of the semiconductor wafer exposed by the patterning. The barrier material may serve to isolate the silicon circuitry formed in and on the semiconductor wafer from the copper interconnection.

Subsequent to providing the layer of barrier material, a thin conducting layer may be deposited over the barrier material. This "seed" layer may act to carry the electrical current for the electroplating process. While the thin conducting layer may comprise any metal(s) or alloy(s), typically, the thin conducting layer is copper.

After providing a seed layer, the metal to make up the interconnection structure may be electrodeposited over the entire surface of the wafer, filling the patterns of lines and vias in the dielectric and simultaneously forming an "overburden" on the top of the dielectric. The overburden may then be removed. Typically, the removal is accomplished by chemical-mechanical polishing.

In some cases, a dual damascene technique may be utilized. A dual damascene technique is described by U.S. Pat. No. 5,814,557, the entire contents of the disclosure of which is hereby incorporated by reference. According to the dual damascene technique, two levels, a via level and a line level, may be patterned and deposited in a single step. By creating both of these levels simultaneously, a dual damascene technique may provide cost savings.

SUMMARY OF THE INVENTION

The present invention provides a method of reducing etching of a seed layer by a plating solution prior to the initiation of plating. The method includes diminishing the etching power of the plating solution.

Additionally, the present invention concerns a method of electroplating interconnection structures on a semiconductor wafer. The method includes depositing a layer of dielectric material on a surface of a semiconductor wafer comprising integrated circuits. The layer of dielectric material is patterned, exposing a portion of the semiconductor wafer. The patterning matches a desired pattern of interconnect structures to be deposited on the semiconductor wafer. A layer of a barrier material is deposited over the patterned layer of dielectric material. An electrically conducting seed layer is deposited on the layer of barrier material. The wafer is introduced into a plating solution having a lowered etch rate with respect to the metal included in the conducting seed layer. A plating current is initiated to electrodeposit at least one metal over the entire surface of the wafer. An overburden of electroplated metal and the seed layer and barrier layer lying on top of the layer of dielectric material are removed leaving a planar structure of interconnect lines and/or vias isolated by the dielectric material.

Furthermore, the present invention pertains to a deaerated plating solution. The solution includes at least one metal to be plated on a seed layer, at least one acid, and a level of dissolved oxygen less than about $10^{-7}$ to about $5\times10^{-6}$ moles/liter.

Still further, the present invention provides a plating tool that includes a plating cell and a plating solution reservoir. A supply line feeds plating solution from the plating solution reservoir to the plating cell. A return line feeds plating solution from the plating cell to the plating solution reservoir. An inert gas supply introduces inert gas into the plating solution.

Still other objects and advantages of the present invention will become readily apparent by those skilled in the art from the following detailed description, wherein it is shown and described only the preferred embodiments of the invention, simply by way of illustration of the best mode contemplated of carrying out the invention. As will be realized, the invention is capable of other and different embodiments, and its several details are capable of modifications in various obvious respects, without departing from the invention. Accordingly, the drawings and description are to be regarded as illustrative in nature and not as restrictive.

BRIEF DESCRIPTION OF THE DRAWINGS

The above-mentioned objects and advantages of the present invention will be more clearly understood when considered in conjunction with the accompanying drawings, in which.

DETAILED DESCRIPTION OF THE INVENTION

Electroplating in damascene technologies generally entails making electrical contact to the thin conducting layer, or seed layer, at one or, preferably, a multiplicity of points at the edge of the wafer. In some kinds of plating tools, the contact area is exposed to the plating solution. Exposure of the seed layer to the plating solution can result in etching of the seed layer, because the plating solution can include very corrosive materials. Any etching of the thin conducting layer in the plating bath can imperil the contact and as a result the quality of the plated metal.

Furthermore, the ability of electroplating processes to fill damascene patterns, particularly dual damascene patterns, which have increasingly high aspect ratios as the dimensions of VLSI technology shrink and which may have essentially vertical side walls, is critically dependent on the integrity of the conductive, or seed, layer that carries the plating current. Missing seed layer, whether as a result of problems in deposition, etching by the plating solution or other problems can lead to a void in the electroplated metal. Voids in the lines substantially increase their resistance and result in poor reliability.

Etching of the seed layer can be exacerbated by techniques utilized to help ensure successful plating in small and/or high aspect ratio structures. Along these lines, often, to facilitate plating in these structures, the substrates including the structures are permitted to dwell in the plating bath for a period of time before plating begins. The dwell time provides time to permit the plating solution to migrate into the structures. However, the increased time of exposure to the plating solution can aggravate the problems with etching of the seed layer by the plating solution.

Still further, the thickness of the seed layer, which is typically deposited by physical vapor deposition (PVD), is greatest on top of the dielectric and least on the side-walls and bottoms of the lines and vias of a damascene pattern, particularly a dual damascene pattern. Often, it is necessary to minimize the thickness of the seed layer in order to keep the seed layer dimension small relative to the pattern dimension, which may be below about 0.2 $\mu$m. Although many advances have been made in the physical vapor deposition techniques used to deposit the conducting layer, coverage of the seed layer on the sides and bottoms of damascene patterns, and particularly dual damascene patterns, is often marginal.

Figure 1:
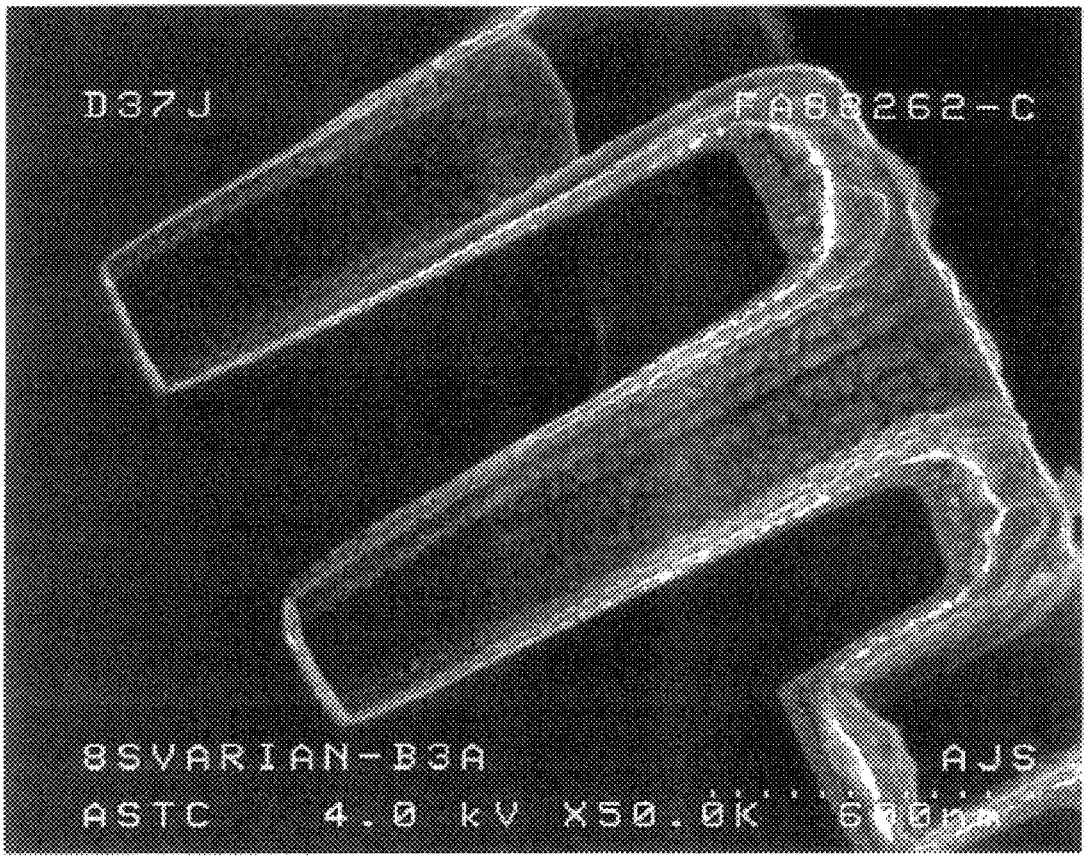
FIG. 1 represents a photomicrograph illustrating a high aspect ratio via with liner and seed layers deposited by physical vapor deposition.

Along these lines, FIG. 1 illustrates the coverage in a high-aspect-ratio via of the liner and seed deposited by PVD. As FIG. 1 illustrates, the thickness of the liner/seed can become progressively less toward the bottom of the via. As stated above, such thin seed layers are more susceptible to being completely removed when attacked by the plating solution.

Marginal seed layers that are barely continuous after deposition can be further thinned by the formation of a native oxide and by dissolution of the oxide in the acidic plating bath before the initiation of plating. As a result, voids can form in lines, and the performance and reliability of the chip can be unsatisfactory.

Electroplating is particularly useful for depositing metals, and particularly copper, in back-end-of-the-line (BEOL) interconnections. For example, electroplated copper interconnections have been used in CMOS devices. As a result of the usefulness of electroplating and the desirability of utilizing copper in interconnection structures, it is desirable to find a solution to the above-described problems.

The present invention can minimize chemical attack on seed layers, particularly in metal lines and trenches, that can occur in the plating bath before the current is engaged. Also, the present invention can help to prevent dissolution of conducting seed layer that can occur in the vicinity of the electrical contacts to a semiconductor wafer surface. Additionally, the present invention can permit use of very thin seed layers in the damascene fabrication techniques for on-chip interconnections using electroplated copper. The present invention is particularly favorable for use in electroplating of copper in BEOL structures.

The present invention may be used with any metal plating operation. The present invention especially relates to the electroplating of metals on parts having thin current-carrying "seed" layers on which the deposition takes place. More particularly, the invention protects very thin current-carrying layers from attack by the plating solution in the period before the plating current is applied. The invention is particularly relevant for applications requiring very thin current-carrying layers, such as the plating of Cu in submicron features during damascene fabrication of interconnections on VLSI chips.

In particular, the present invention is particularly useful for use in applications where copper interconnections are to be deposited by electroplating on a seed layer on a semiconductor wafer including integrated circuits. The present invention can be useful for helping to improve reliability of electrical contact to a seed layer for plating and protecting the electrical contact to the seed layer.

The seed layer may be any seed layer. However, as referred to above, the present invention is particularly useful where the seed layer includes a thin copper conducting layer, particularly where copper is being plated. The seed layer is provided on the top surface and on the bottom and side walls of damascene structures on a semiconductor wafer comprising integrated circuits on which copper interconnections are to be deposited by electroplating. Typically, the seed layer covers all portions of these surfaces. This will help to ensure that the subsequently plated copper will cover all surfaces.

Typically, the present invention is especially useful for seed layers having a thickness on the top surface of about 20 nm to about 250 nm. In particular, the present invention is useful for seed layers having a top surface thickness of 60 nm or less. Typically, the thickness of the seed layer in the features is much less than the thickness of the seed layer on the top surface.

The present invention finds particularly favorable use where the damascene structures include dual damascene structures. Furthermore, the present invention provides especially favorable results where the damascene structures comprise high aspect ratio lines and/or vias with dimensions less than about 0.2 $\mu$m.

The present invention accomplishes the above as well as other functions by providing a method of reducing etching of a seed layer by a plating solution. The method includes diminishing the etching power of a plating solution prior to initiating the plating current. As referred to above, a plating bath can be an etching environment. Specifically, a thin seed layer, such as a copper seed layer, may dissolve at open circuit in an acid copper plating bath.

With respect to a copper seed layer, two forces drive the oxidation of copper metal. A first force is the presence of oxygen in the plating bath. A second force is the possibility of the disproportionation reaction $Cu+Cu(II) \rightarrow 2Cu(I)$. This disproportionation reaction is further driven toward the right by the presence of oxygen, which decreases the concentration of the Cu(I) by oxidizing this species to Cu(II).

Thus, removal of dissolved oxygen from the vicinity of a wafer surface will decrease the attack on the thin conducting seed layer by the plating bath. The oxygen supply to the wafer surface can be limited by using very low levels of solution agitation. A very effective means of reducing the oxygen concentration at the wafer surface, however, is the deaeration of the plating solution by bubbling with an inert gas.

Removal of oxygen from plating solutions is one means of protecting the conductive layer until the plating current is applied. This is in contrast to typical plating processes, which include introduction of oxygen or oxygen-containing ambient air into the plating solution. The bubbling of inert gas according to the present invention can be performed in the reservoir, thus avoiding the introduction of possibly-deleterious bubbles in the plating chamber. The inert gas may be pre-saturated with water to avoid rapid evaporation of the plating bath.

Any inert gas may be utilized according to the present invention. Among the inert gasses that may be utilized is nitrogen. However, any gas that is non reactive in the conditions of the plating bath may be utilized. For example, argon and helium are other inert gases that may be utilized to deaerate aqueous solutions.

Figure 2:
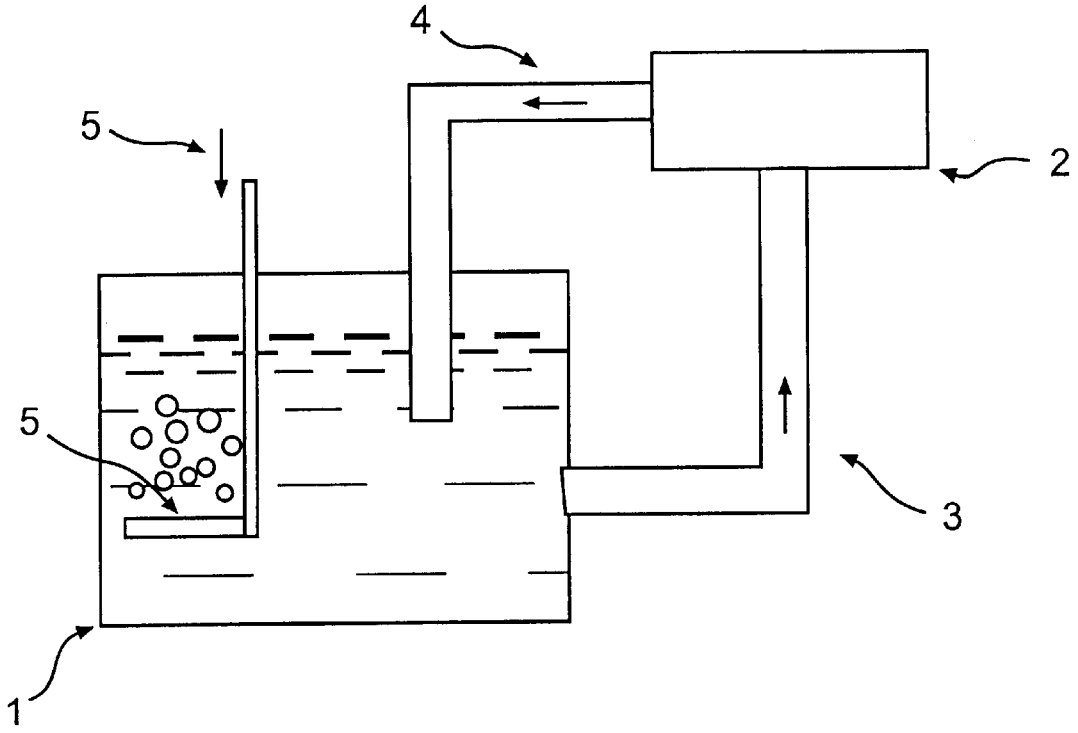
FIG. 2 represents a schematic drawing illustrating an embodiment of a plating system including elements for eliminating dissolved oxygen from a plating bath.

FIG. 2 illustrates one embodiment of a system according to the present invention including elements for introducing inert gas into a plating solution. The plating tool illustrated in FIG. 2 includes a reservoir 1 for holding a plating solution. Plating solution is supplied from the reservoir 1 to a plating cell 2 through a circulation path having a supply line 3 and a return line 4.

Inert gas is introduced into the plating solution while the plating solution is in the reservoir 1. The inert gas is fed through a bubbler 5 from a supply line 6. The supply line may also provide a means of saturating the gas with water vapor. Saturation of gas with water vapor is typically accomplished using a bubbler to introduce bubbles of gas in purified water. Those skilled in the art are well aware of how to accomplish such saturation. Although the embodiment illustrated in FIG. 2 includes elements for introducing the inert gas into the plating solution in the reservoir, the inert gas could be introduced into the plating solution anywhere in the system, including the lines 3 and 4 as well as the plating cell 2.

The inert gas may be introduced into the plating solution at a rate of about 1 to about 5 liters/min. The rate of supply of the inert gas and the deaeration time may depend, at least in part, on the volume of the plating solution. For example, deaeration of about 50 liters of plating solution may be accomplished in about 15 minutes with a gas flow of about 1 liter per minute. An oxygen sensor can be utilized to monitor the oxygen level in the solution, if desired.

Prior to introduction of the inert gas, the level of dissolved oxygen in the plating solution may be from about $1\times10^{-4}$ to about $5\times10^{-4}$ moles/liter. After introduction of the inert gas, the level of dissolved oxygen in the plating solution may be from about $10^{-7}$ to about $5\times10^{-6}$ moles/liter.

The level of oxygen may be reduced by more than 99% as compared to a plating solution that is saturated with air. According to one embodiment, the etching rate of copper was reduced by about 42%. Typically, the etching power of the plating solution may be reduced by about 20% to about 50%.

When quantified, according to one embodiment, a plating solution etched a seed layer at an average rate of about 0.043 nm/sec prior to carrying out the present invention under agitation conditions representative of a typical plating tool. After carrying out the present invention, the etching power of the solution was reduced to an average rate of about 0.025 nm/sec. These are average rates. The rate may be higher near a contact or in regions of locally higher agitation.

The present invention also concerns a deaerated plating solution. The plating solution includes at least one metal to be plated on a seed layer, at least one acid, and a level of dissolved oxygen less than about $10^{-7}$ to about $5\times10^{-6}$ moles/liter. The solution may also include an inert gas dissolved therein. However, it is not necessary that the solution include any dissolved inert gas. The plating solution may also include a certain amount of water.

In addition to the above, the present invention also relates to a method of electroplating interconnection structures on a semiconductor wafer. The method includes depositing a layer of dielectric material on a surface of a semiconductor wafer comprising integrated circuits. Next, the layer of dielectric material is patterned to expose a portion of the semiconductor wafer. Typically, the patterning matches a desired pattern of interconnect structures to be deposited on the semiconductor wafer.

A layer of a barrier material may then be deposited over the patterned layer of dielectric material. After depositing the barrier layer, an electrically conducting seed layer is deposited on the layer of barrier material. The semiconductor wafer with the exposed seed layer is introduced into a plating solution.

Prior to commencing plating, at least the seed layer may be exposed to the plating solution for a period of time. This "dwell" time may help to ensure removal of bubbles from adjacent the substrate and to help ensure contact of all portions of the seed layer with the solution. Along these lines, time may be required to help ensure that the solution migrates into all structures defined in the dielectric layer. The dwell times before the current is applied are typically on the order of about 1 second to about 10 seconds.

Before introduction of the semiconductor wafer into contact with the plating solution, the etching power of the plating solution is reduced. This may be accomplished as described above. If reducing the etching power of the solution includes introducing inert gas into the plating solution, the inert gas introduction may start prior to, during, or after introduction of the plating solution into the plating cell. It may not be necessary to continue introduction of the inter gas after plating has started since plating of metal the seed layer can protect the seed layer, making it safe from etching once the current is turned on. On the other hand, it might be more practical to continue the inert gas introduction and consequent oxygen removal.

A plating current is initiated to electrodeposit at least one metal over the entire surface of the seed layer. The plating time may be about 1 minute to about 5 minutes for copper interconnections on chips. The overburden of electroplating metal and the seed layer and barrier layer lying on top of the layer of dielectric material may then be removed.

Furthermore, the present invention includes a plating tool. The plating tool includes a plating cell for holding a plating solution and into which a substrate on which metal is to be plated is introduced. A plating solution reservoir contains at least a portion of the plating solution. A supply line feeds plating solution from the plating solution reservoir to the plating cell. A return line feeds plating solution from the plating cell to the plating solution reservoir. An inert gas supply introduces inert gas into the plating solution. The inert gas supply may be substantially as described above and as shown in FIG. 2.

The foregoing description of the invention illustrates and describes the present invention. Additionally, the disclosure shows and describes only the preferred embodiments of the invention, but as aforementioned, it is to be understood that the invention is capable of use in various other combinations, modifications, and environments and is capable of changes or modifications within the scope of the inventive concept as expressed herein, commensurate with the above teachings, and/or the skill or knowledge of the relevant art. The embodiments described hereinabove are further intended to explain best modes known of practicing the invention and to enable others skilled in the art to utilize the invention in such, or other, embodiments and with the various modifications required by the particular applications or uses of the invention. Accordingly, the description is not intended to limit the invention to the form disclosed herein. Also, it is intended that the appended claims be construed to include alternative embodiments.

We claim:

1. A method of reducing etching of a seed layer by a plating solution, the method comprising:

(a) providing a circuitized semiconductor wafer;

(b) providing a plating tool, comprising:
- a plating cell;
- a plating solution reservoir;
- a supply line for feeding plating solution from the plating solution reservoir to the plating cell;
- a return line for feeding plating solution from the plating cell to the plating solution reservoir;
- a contact area for providing electrical contact to said wafer and
- an inert gas supply for introducing inert gas into the plating solution;

(c) diminishing an etching power of the plating solution prior to exposing the seed layer to the plating solution; and (d) initiating a plating current through said contact area.

2. The method according to claim 1, wherein the etching power of the plating solution is diminished by reducing a concentration of dissolved oxygen in the plating solution.

3. The method according to claim 2, wherein reducing the concentration of dissolved oxygen comprises bubbling an inert gas through the plating solution.

4. The method according to claim 3, wherein the inert gas comprises nitrogen.

5. The method according to claim 3, further comprising: saturating said inert gas with water prior to introducing said inert gas into the plating solution.

6. The method according to claim 1, wherein the seed layer is deposited on a semiconductor wafer comprising integrated circuits on which copper interconnections are to be deposited by electroplating.

7. The method according to claim 1, wherein the seed layer comprises a thin conducting layer over the entire wafer surface including the bottom and side walls of damascene structures on a semiconductor wafer comprising integrated circuits on which copper interconnections are to be deposited by electroplating.

8. The method according to claim 7, wherein the damascene structures include dual damascene structures.

9. The method according to claim 8, wherein the damascene structures comprise high aspect ratio lines and vias.

10. The method according to claim 1, wherein the seed layer comprises a seed layer for electroplating copper on the semiconductor wafer.

11. The method according to claim 10, wherein the seed layer in the vicinity of said electrical contact, which is made to allow plating on the wafer, is exposed to the plating solution.

12. The method according to claim 1, wherein the seed layer has a thickness of about 20 nm to about 250 nm.

13. The method according to claim 1, wherein the seed layer has a thickness less than about 60 nm.

14. The method according to claim 3, wherein the inert gas is bubbled into the plating solution prior to exposing the seed layer to the plating solution.

15. The method according to claim 14, wherein the seed layer is exposed to the plating solution in a plating cell and the inert gas is bubbled into the plating solution in a plating solution reservoir.

16. The method according to claim 1, wherein the etching power of the plating solution is diminished by deaerating the plating solution.

17. The method according to claim 16, wherein the level of dissolved oxygen in the plating solution is about $10^{-7}$ to about $5\times10^{-6}$ moles/liter.

* * * * *